US006120845A

United States Patent [19]

Pease

[11] Patent Number: 6,120,845

[45] Date of Patent: Sep. 19, 2000

[54] METHOD FOR APPLYING A DECORATIVE FINISH TO THE SURFACE OF AN OBJECT

[76] Inventor: Scott Norton Pease, 805 S. Adams, Hinsdale, Ill. 60521

[21] Appl. No.: 09/234,378

[22] Filed: Jan. 20, 1999

[51] Int. Cl.[7] ..... B05D 1/38

[52] U.S. Cl. ..... 427/256; 427/262; 427/421

[58] Field of Search ..... 427/256, 262, 427/421

[56] References Cited

U.S. PATENT DOCUMENTS 3,580,768 5/1971 Kukla .

*Primary Examiner*—Fred J. Parker

*Attorney, Agent, or Firm*—Orrick, Herrington & Sutcliffe LLP

[57] ABSTRACT

A surface of an object to be decorated is provided with a first color. A liquid, such as water, is applied to the surface to form a plurality of drops. A coloring agent having a second color, such as conventional spray paint, is applied to the surface over the drops. The liquid is then removed from the surface, for example, by evaporation or allowing the liquid to drip off of the surface, and the coloring agent is dried. A protective coating is optionally applied over the finished surface. To apply the decorative finish to a three-dimensional surface, the same process is used except, the liquid is first applied to a first portion of the surface to form a plurality of drops. The liquid is then frozen in place so that the liquid may then be applied to a second portion of the three-dimensional surface. The application of the liquid and freezing is repeated until a desired section of the surface has been covered with liquid drops, the coloring agent and optional a protective coating are then applied as in the two-dimensional process.

3 Claims, 6 Drawing Sheets

METHOD FOR APPLYING A DECORATIVE FINISH TO THE SURFACE OF AN OBJECT

FIELD OF THE INVENTION

The present invention relates to a method for applying a decorative finish to the surface of an object, wherein the finish has the appearance of water drops and/or droplets.

BACKGROUND OF INVENTION

One type of decorative finish which has been used on various surfaces gives the appearance of water drops and/or droplets on the surface of an object. The desired look is achieved by painting (or otherwise coloring) light colored circles and/or part circles on a darker background. The painting has in the past been done manually, by painting each individual droplet using a brush or the like. This method is, however, very time consuming in that each drop must be individually painted. It is also an imperfect process in that the success of the effect depends, to a large degree, on the skill of the artist in painting the water drops.

An alternative method which yields more consistent results involves the use of a silkscreen or similar process to color a large number of drops simultaneously. This results in a much quicker application of the coloring agent, however, the production of the screen is time consuming. Further, this method suffers in that the pattern produced is not truly random, but is set by the design in the silk screen. If an area larger than the screen is to be colored, the same pattern is used multiple times, resulting in a repetitive rather than random design. Lastly, this method does not allow for easy modification of the pattern since a new screen must be produced to change the pattern significantly.

The above method additionally suffers in its inability to easily apply such a decorative finish to a three-dimensional surface of an object.

SUMMARY OF THE INVENTION

It is, therefore, an object of the present invention to provide a method for quickly and easily applying a decorative finish to the surface of an object.

Another object of the present invention is to provide a method for applying a decorative finish resembling water drops to the surface of an object.

A further object of the present invention is to provide a method for applying a decorative finish resembling water drops to a three-dimensional surface of an object.

The above and other objects are achieved in accordance with a first aspect of the present invention by providing a surface of the object to be decorated with a first color. A liquid, such as water, is applied to the surface to form a plurality of drops. A coloring agent having a second color, such as conventional spray paint, is applied to the surface over the drops. The liquid is then removed from the surface, for example, by evaporation or allowing the liquid to drip off of the surface, and the coloring agent is dried. A protective coating is optionally applied over the finished surface.

In a second aspect of the present invention, the decorative finish is applied to a three-dimensional surface of an object in the same manner as a two-dimensional surface. To position the liquid drops on the three-dimensional surface, however, the liquid is first applied to a first portion of the surface to form a plurality of drops. The drops are then frozen in place so that the liquid may then be applied to a second portion of the three-dimensional surface. The application of the liquid and freezing is repeated until a desired section of the surface has been covered with drops.

These and other objects, features and advantages of the present invention will be apparent and fully understood from the following detailed description of the preferred embodiments, taken in connection with the appended drawings in which like reference numerals describe corresponding features.

BRIEF DESCRIPTION OF THE DRAWINGS

It should be noted that the above drawings are not drawn to scale in order to more easily illustrate the present invention. In addition, while FIG. 1 is a black and white representation of an actual finish produced in accordance with the present invention, shading has been omitted from the other figures for the sake of clarity.

DETAILED DESCRIPTION OF THE PREFERRED EMBODIMENT

Figure 1:
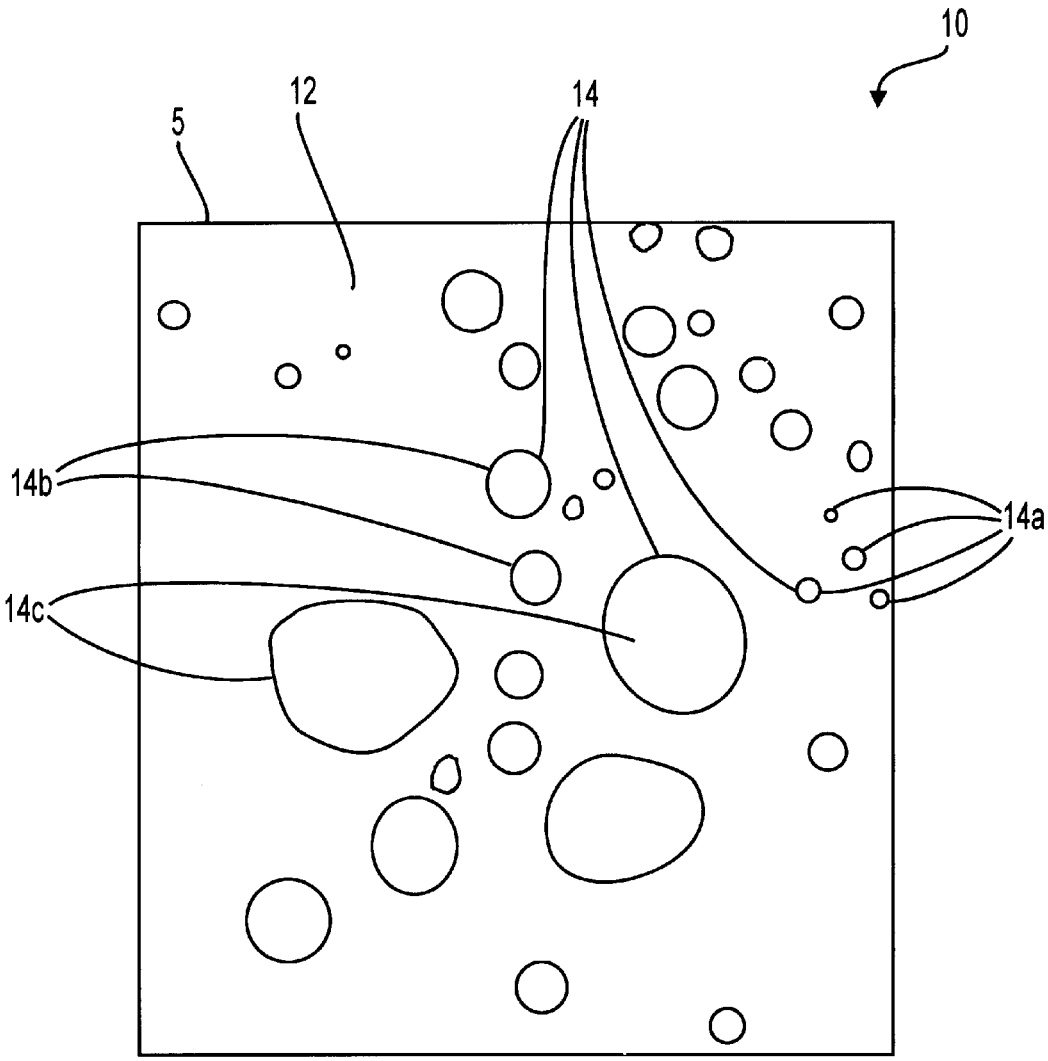
FIG. 1 is an illustration of a decorative finish produced according to the present invention.

FIG. 1 illustrates an example of the finish 10 created by the method of the present invention. As may be observed, the surface 5 has a dark background 12 and a plurality of lighter colored drop images 14, including droplet images 14*a*, larger drop images 14*b* and pool images 14*c*. It should be noted that while the illustration is in black and white with a dark background 12 and lighter drop images 14, the selection of colors is a matter of individual choice. Further, the use of the phrase "drop" in the specification and throughout the claims should be understood to include drops, droplets, pools and other collections of liquid, regardless of size, shape or composition.

To produce the decorative finish 10 of FIG. 1 in accordance with the present invention, the surface 5 of an object 1 to be so decorated is first prepared, if necessary, by being cleaned and dried. In addition, it is preferable that the surface 5 be smooth to encourage the formation of drops 20, although non-smooth surfaces may also be used. The surface 5 should also preferably be water-repellant, again to aid in the formation of water drops 20. If the surface 5 is not water-repellant, a water-repellant coating is preferably applied. (The term water-repellant when used to describe the surface 5, and this initial coating of the surface 5, means only that the water beads-up, or forms drops 20 on the surface 5 and is not absorbed by it.) The water-repellant coating may also include a colorant so as to provide the desired color for the background 12 of the finish 10 if the surface 5 is not already of the desired color. Enamel spray paint has been found to provide a suitable water-repellant coating while at the same time providing the desired background coloring.

Figure 2:
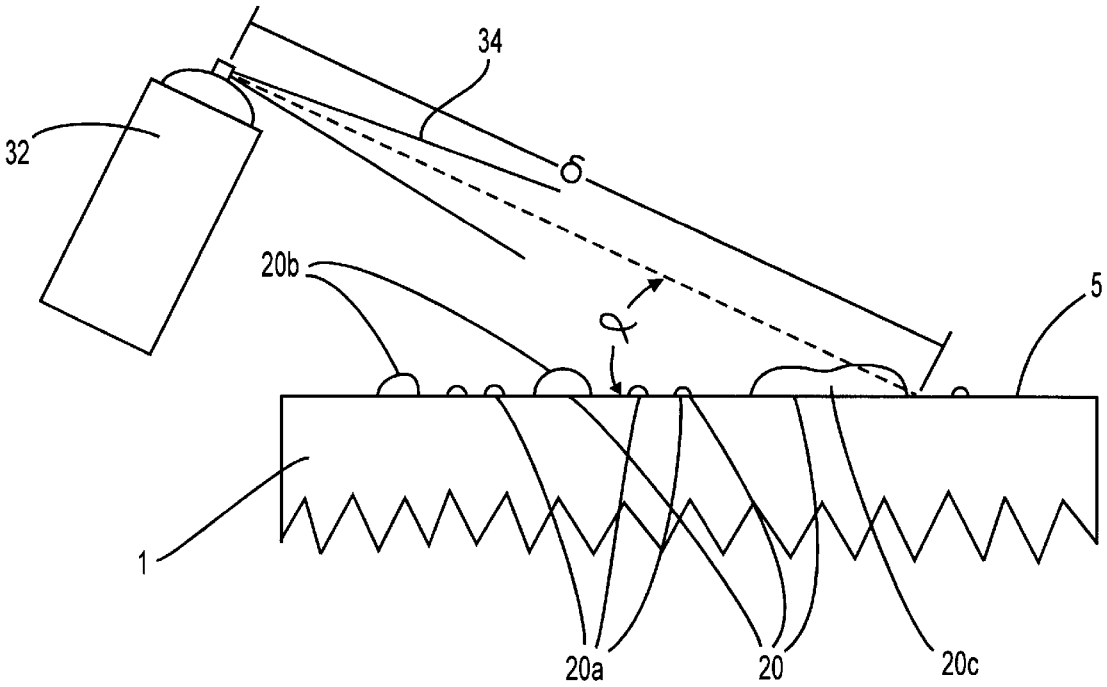
FIG. 2 is a side elevational view of a spray paint being applied to a surface in accordance with the present invention.

Once the surface 5 has been prepared, it is dried and placed in a horizontal orientation, as shown in FIG. 2. Water is then applied, using any suitable method, so as to form a plurality of water drops 20 on the surface 5. If, for example, a random pattern of small droplets 20*a* is desired, the water may be sprayed or misted onto the surface 5 using a common spray bottle. Alternatively, if larger drops 20*b* or pools 20*c* are desired the water may be applied using a conventional liquid dropper. Since the pattern of the water drops 20 will dictate the pattern of drop images 14, as will be described below, the artisan can manipulate the water at will to create the desired pattern. If a mistake is made, the water drops 20 can be easily modified to correct the error or completely removed to start again.

When the desired pattern of water drops 20 is completed a paint, such as conventional spray paint, is then sprayed over the surface 5, including the water drops 20. A water-repellant paint is used so that it does not mix with the water drops 20, but instead forms a coating on the drops 20 which slides partially off the drops and onto the surface 5 as the drops 20 dry. (As used in describing the paint, water-repellant means only that the paint does not readily mix with the water, as described herein above.) If commercial enamel spray paint leaves a thicker mist than desired, a paint spray gun with appropriate filters can alternatively be used and the term "spray paint," as used throughout this description, is intended to cover both forms of sprayed paint.

To achieve an image 14 which resembles actual water drops, as shown in FIG. 1, multiple coats of paint are applied to the water drops 20, each successive coat having the same hue as the surface 5, but a lighter appearance. (Again, it is noted that the selection of colors is a matter individual choice, for example, contrasting hues may be used to give a glowing appearance.) Care is taken between coats to allow the previous coat to dry slightly before applying the next coat to avoid unwanted mixing of colors. However, if too much time is allowed to pass, the water may evaporate significantly.

The paint must be carefully applied so that the pressure from the paint spray 34 does not alter the pattern of water drops 20. Thus, the angle of incidence $\alpha$ of the spray 34 and distance $\delta$ between the surface 5 and the spray can 32 must be carefully selected through trial and error. The spray paint is applied at a low angle of incidence $\alpha$, typically between 5° and 45°, as shown in FIG. 2. This applies most of the paint to the sides of the drops 20, with only a minimal amount being sprayed directly onto the surface 5. To achieve the look of a single light source, or light coming from only one direction, the angle of incidence $\alpha$ is maintained throughout the application of each coat. In addition, to further aid in the effect, the spray paint for each coat is applied to the water drops 20 over the entire surface 5 by moving the spray can 32 in the X and Y directions over the surface 5, while the direction of the spray 34 relative to the X-Y plane of the surface 5 is maintained. However, both the angle of incidence and the direction of application may be varied from coat to coat.

Figure 3:
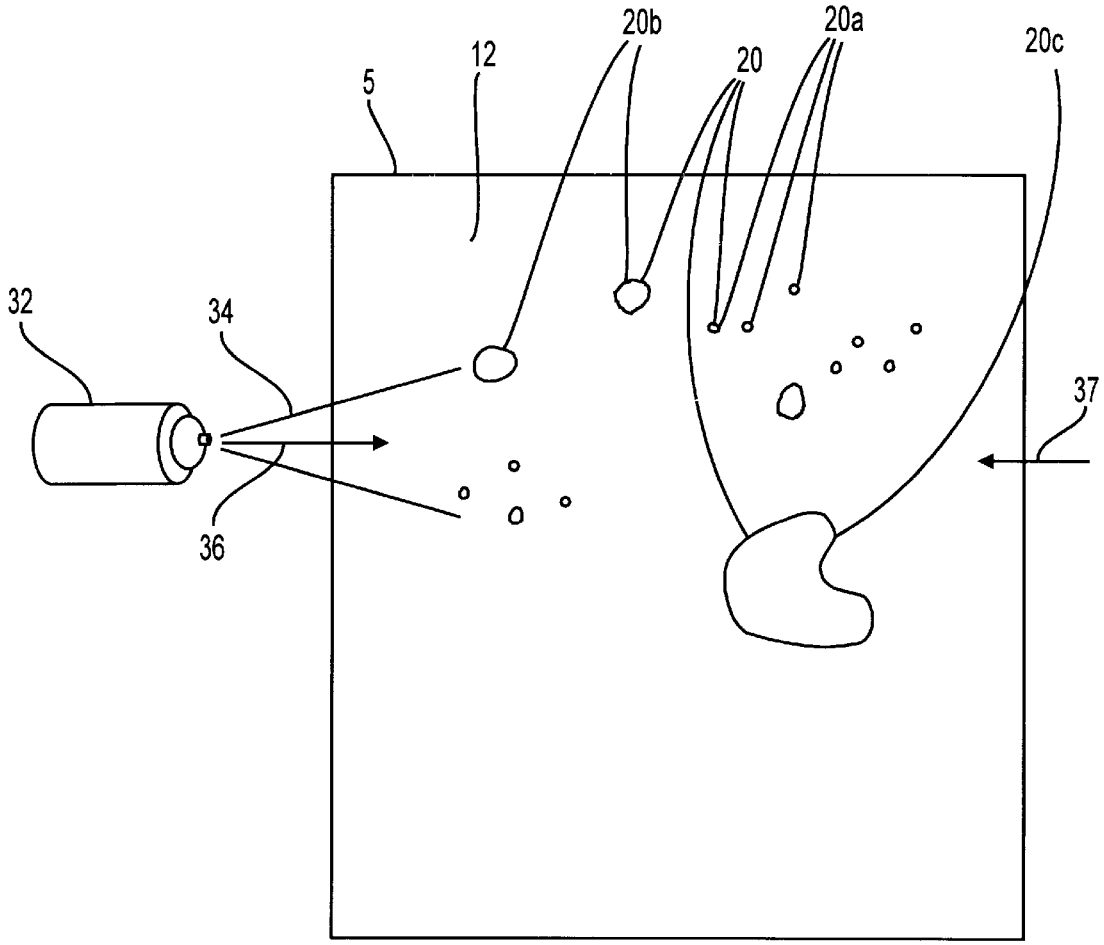
FIG. 3 is a plan view of a spray paint being applied to a surface in accordance with the present invention.

In the illustrated example, two coats of the same hue as the surface 5 are applied, each coat being successively lighter in appearance, followed by a third coat of white, with less paint being applied in each successive coat. The first coat is applied by spraying the paint in the direction indicated by reference numeral 36 in FIG. 3. The second coat, which is lighter in appearance than the first is then applied by spraying in the opposite direction 37 as used to apply the first coat in order to apply the paint to the opposite side of the drops 20. This gives the appearance of one side of the drop image 14 being lighter than the other due to the positioning of a light source. Finally, the third coat (white) is applied in the same direction 37 as the second coat, to provide additional highlights. This final coat may be applied at a different angle of incidence $\alpha$ in order to enhance the effect.

When the coats of paint have been completely applied to produce the desired finish 10, the surface 5 is allowed to dry. Typically 8–12 hours is sufficient, however, this time may vary depending on the time required for the paint to dry and the water to evaporate. At this point, it may be necessary to smooth the paint where the evaporation of larger drops 20*b* or pools 20*c* may have created folds or other defects in the "skin" of the paint. This can be done simply by pushing down, or otherwise manipulating, the paint using a finger or some other object to which the paint will not adhere.

Lastly, the finished surface 5 may optionally be coated with a commercially available sealant, such as Tile Lab Surface Guard Sealer, or some other protective coating to protect the finish 10 from wear and/or deterioration. This is particularly useful if the finished surface 5 is to be used as a flooring material, for example, on tiles, where the surface 5 will be subject to excessive abrasion. Alternatively, the entire process may be modified for the use of glazes, which can then be fired, provided appropriate high temperature coloring agents are used.

In a second aspect of the present invention, the process is modified to apply a decorative finish 10 to a three-dimensional surface of an object, for example, the outer surface 105 of a cup 101. The three-dimensional process is similar to the two-dimensional one already described, except, because the surface 105 being decorated is not planar, it cannot be laid completely horizontally for the placement of water drops 20. To overcome this problem, the water drops 20 are applied to the surface 105 in stages and frozen in place.

Figure 4A:
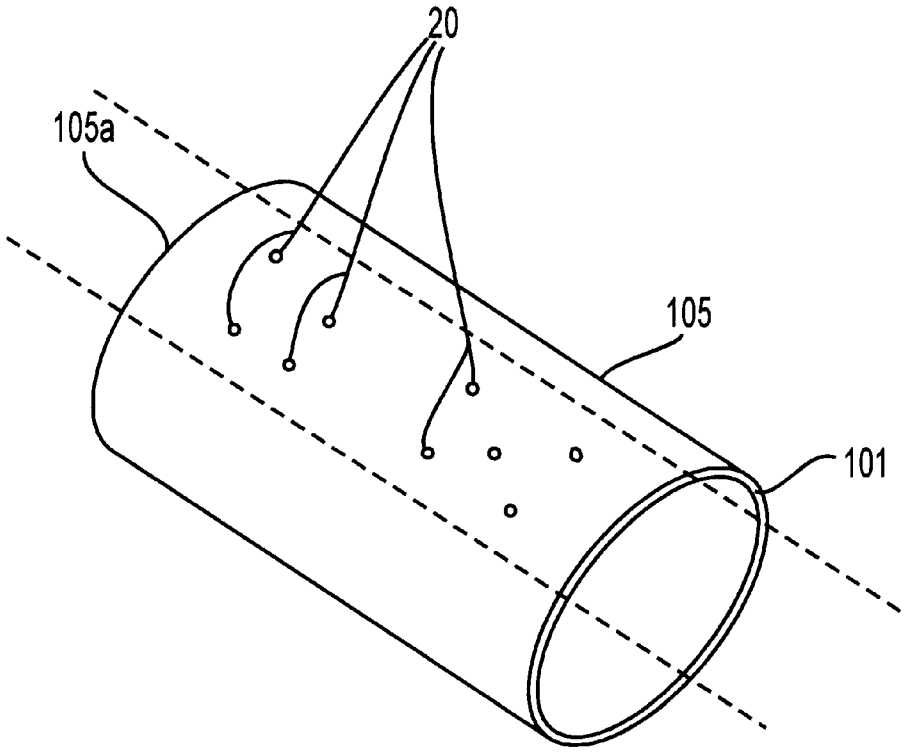
FIG. 4*a* is a perspective view of water drops being applied to a first portion of the outer surface of a cup in accordance with the present invention.
Figure 4B:
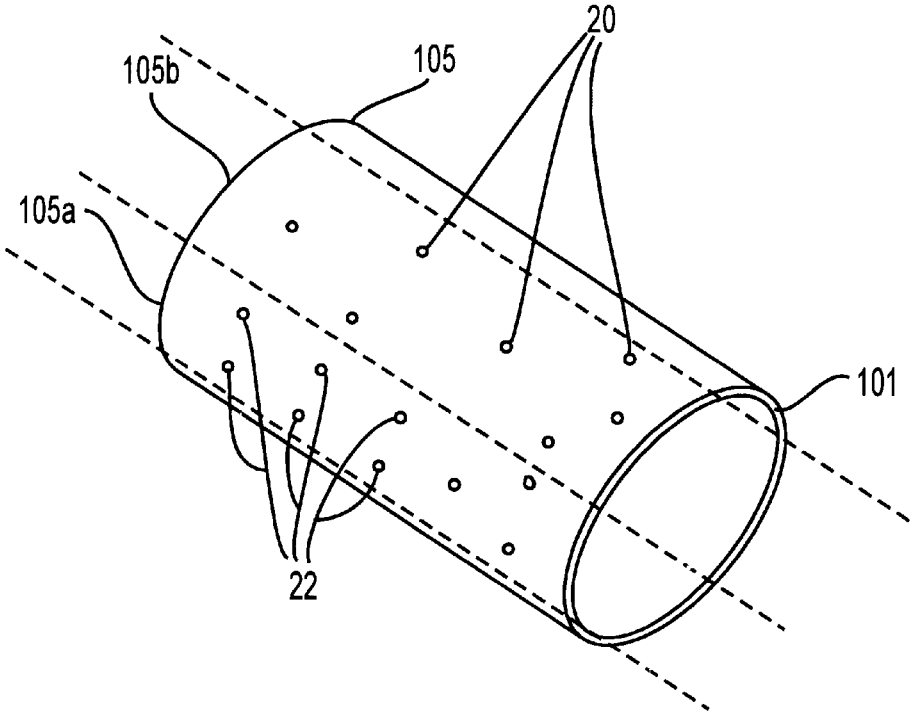
FIG. 4*b* is a perspective view of water drops being applied to a second portion of the outer surface of a cup in accordance with the present invention.

Referring to FIG. 4*a*, water is applied to a first portion 105*a* of the circumferencial outer surface 105 of the cup 101, for example on ¼ of the total circumferencial surface 105, by spraying or some other method. The drops 20 are then frozen in place by placing the cup 101 in a cooler of dry ice or liquid nitrogen. (Other methods of freezing the drops 20, such as a conventional freezer set at −20° to 20° F. may also be used, however, these tend to slow the process.) Once the drops 20 are frozen to form ice drops 22, the cup 101 may be rotated and the ice drops 20 will continue to adhere to the cup 101 where they were placed. Water may now be applied to a second portion 105*b* of the outer surface 105, FIG. 4*b*.

Figure 5:
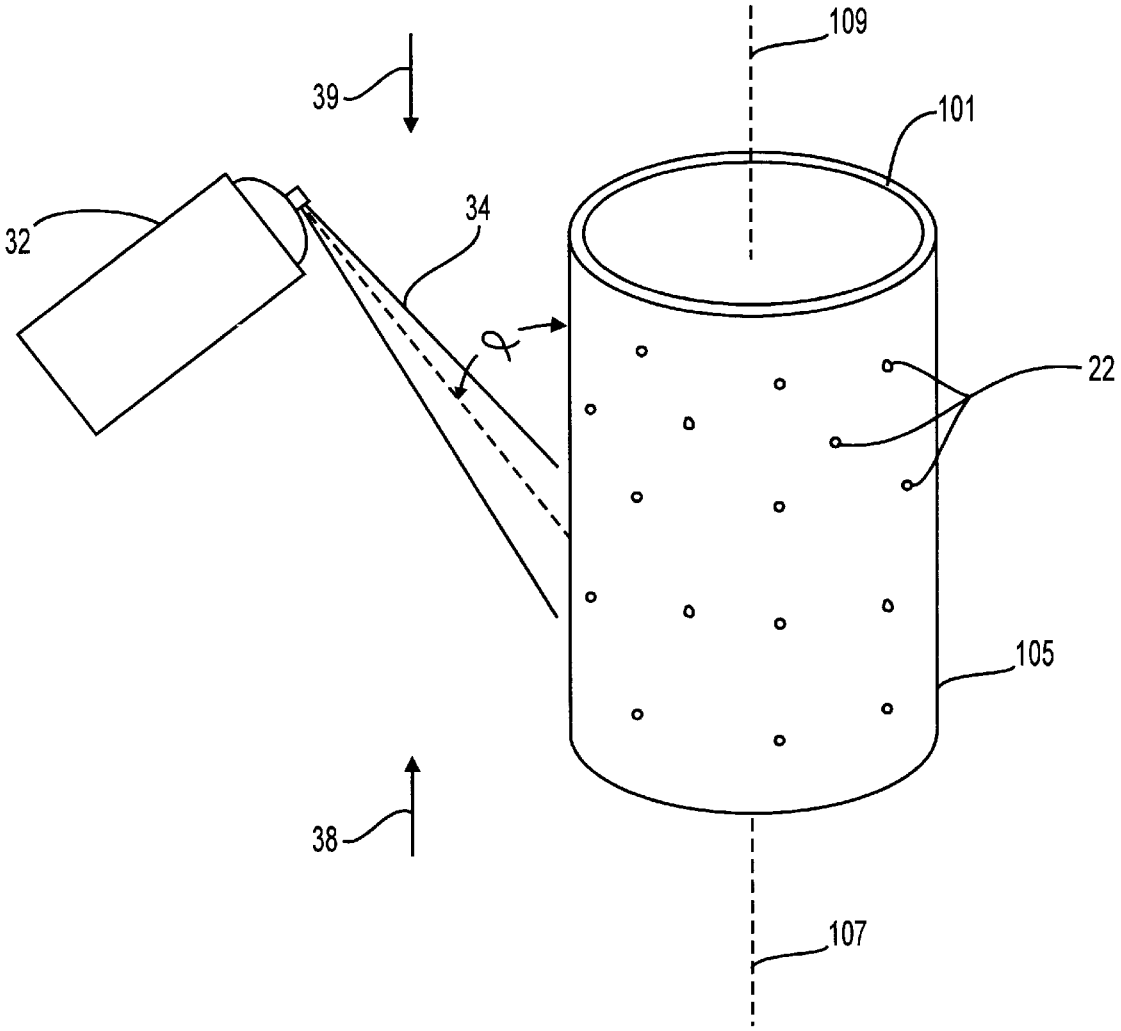
FIG. 5 is perspective view of a spray paint being applied to the outer surface of a cup in accordance with the present invention.

This application of water and freezing is repeated until the desired pattern of water drops 20 (ice drops 22) is placed on the entire outer surface 105 of the cup 101, or a select portion thereof. The surface 105 of the cup 101 with the now frozen water drops 20 (ice drops 22) may then be painted, FIG. 5, as described in connection with the two-dimensional process. In one embodiment, a first coat of paint is applied from the direction of the bottom pole 107 of the cup 101, spraying in the upward direction as indicated by reference numeral 38 in FIG. 5. A second lighter colored coat and a third white coat are then applied from the direction of the top pole 109, spraying downward, as indicated by the spray can 32 in FIG. 5 and reference numeral 39.

To facilitate the application of paint before the ice drops 22 melt significantly (and possibly move out of position) it is preferable to apply the spray paint at approximately the coldest temperature permitted for the proper application of the paint, as indicated by the manufacturer. This temperature, thus, necessarily varies depending on the choice of paint (or other coloring agent). It has been found that an ambient temperature of approximately 38° F. (±5°) is suitable when using conventional spray paint.

After painting the desired number of coats, the cup 101 is allowed to dry at room temperature as in the two-dimensional process. The ice drops 22 will first melt to again become water drops 20 and then, depending on the orientation of the painted surface 105, drip off of the surface 105, leaving the paint behind. Those drops 20 which do not drip off of the painted surface 105 will, of course, evaporate as in the two-dimensional process. In either case, the paint will dry as the water is removed from the surface 105. (It should be noted that depending on the desired finish, the water in the two-dimensional process may likewise be allowed to drip off of the painted surface 5 by appropriately orienting the surface 5, or removed in any other manner.) The cup 101 with the dried finish 10 in place may then be touched up and protected with a protective coating, as previously described.

The present invention has been described in terms of illustrated embodiments thereof. Other embodiments, features and variations within the scope of the appended claims will, given the benefit of this disclosure, occur to those having ordinary skill in the art. For example, coloring agents other than paint, for example dyes or stains, may also be used. Also, while the present invention has been described in terms of using water on a water-repellant surface, with water-repellant paint, other liquids may be used to form the desired drop pattern, provided the selected liquid forms drops on the surface to be decorated and provided the paint or other coloring agent does not readily mix with the selected liquid. Further, as is well known in the art, the use of different coloring agents will necessarily involve different "drying" procedures, for example, glazes will require curing.

What is claimed is:

1. A method of applying a decorative finish to an object comprising:

(a) providing a surface of the object, said surface having a first color;

(b) applying a liquid to said surface to form a plurality of drops;

(c) freezing said liquid drops;

(d) applying a coloring agent to said surface and said frozen liquid drops, said coloring agent having a second color;

(e) removing the liquid from said surface; and (f) drying said coloring agent.

2. The method according to claim 1 wherein the step of freezing the liquid comprises placing the object in a dry ice or liquid nitrogen cooler.

3. A method of applying a decorative finish to a three-dimensional surface of an object comprising:

(a) providing said three-dimensional surface, said three-dimensional surface having a first color;

(b) applying a liquid to a portion of said three-dimensional surface to form a plurality of drops;

(c) freezing said liquid drops;

(d) repeating steps (b) and (c) until a desired section of the three-dimensional surface has been covered with frozen liquid drops;

(e) applying a coloring agent to said three-dimensional surface and said frozen liquid drops, said coloring agent having a second color;

(f) removing the liquid from said three-dimensional surface; and (g) drying said coloring agent.

* * * * *